US005964487A

United States Patent [19]

Shamblin

[11] Patent Number: 5,964,487

[45] **Date of Patent: *Oct. 12, 1999**

[54] IMPACT RESISTANT SECURITY DOOR AUXILIARY LATCH MECHANISM

[76] Inventor: Rosco Shamblin, 4654 Loganway, Hubbard, Ohio 44425

[ * ] Notice: This patent is subject to a terminal disclaimer.

[21] Appl. No.: 08/937,275

[22] Filed: Sep. 15, 1997

Related U.S. Application Data

[63] Continuation-in-part of application No. 08/908,254, Aug. 7, 1997.

[51] Int. Cl.[6] ..... E05C 1/06

[52] U.S. Cl. ..... 292/144; 292/251.5; 292/341.12; 292/DIG. 23; 292/DIG. 73

[58] Field of Search ..... 292/144, 145, 292/251.5, DIG. 23, DIG. 25, 55, 340, 341.18, 342, DIG. 55, DIG. 56, DIG. 73, 163, 341.12, 341.13

[56] References Cited

U.S. PATENT DOCUMENTS

| | | | |
|---|---|---|---|
| 1,715,672 | 6/1929 | Ottinger | 292/342 |
| 1,947,524 | 2/1934 | Horldt | 16/85 |
| 2,547,108 | 4/1951 | Anderson | 292/170 |
| 3,309,664 | 3/1967 | Deutsch et al. | 340/56 |
| 4,372,419 | 2/1983 | Barnett et al. | 180/289 |
| 5,246,258 | 9/1993 | Kerschenbaum et al. | 292/144 |
| 5,386,713 | 2/1995 | Wilson | 70/280 |
| 5,531,086 | 7/1996 | Bryant | 70/279 |
| 5,546,777 | 8/1996 | Liu et al. | 70/257 |
| 5,572,098 | 11/1996 | Dreon et al. | 318/293 |
| 5,593,191 | 1/1997 | DeMarco | 292/144 |
| 5,655,800 | 8/1997 | DeMarco | 292/167 |
| 5,715,712 | 2/1998 | West | 70/257 |

*Primary Examiner*—Steven Meyers
*Assistant Examiner*—Clifford B. Vaterlaus
*Attorney, Agent, or Firm*—Robert G. Lev

[57] ABSTRACT

A security door latching mechanism and complementary receiver are arranged to be installed within a door and a complementary door jamb. In the preferred embodiment, the installation takes place in a vehicle and the latching mechanism can be installed either in the door or in the door frame or jamb. The latching mechanism includes a plunger shaft which is arranged to extend from the door jamb into the receiver, and is forcibly maintained in the extended position until retracted by an electrical current provided to an actuator. This actuator is spring-driven to keep the plunger shaft in an extended position until provided with an electrical power to retract the plunger shaft. A wedge-shaped guide forces the plunger shaft to slide to the recess when the door is being closed. It is necessary to constantly maintain the electric power to the actuator in order to keep the plunger shaft retracted.

19 Claims, 3 Drawing Sheets

IMPACT RESISTANT SECURITY DOOR AUXILIARY LATCH MECHANISM

RELATED APPLICATIONS

This application is a continuation-in-part of U.S. patent application Ser. No. 08/908,254, filed Aug. 7, 1997.

TECHNICAL FIELD

The present invention relates to door latch mechanisms. In particular, the present invention is directed to a security door auxiliary, latch mechanism which maintains the door in a latched position even when subjected to impact applied both perpendicularly and in parallel to the safety or security door jamb.

BACKGROUND OF THE INVENTION

Door latching mechanisms, especially those used in automobile or other vehicles, typically required latch pins which project from a door post or jamb. These pins are held by a partially revolving clasping mechanism in a manner well known in this art. For the sake of easy operation, the clasping mechanism is easily and automatically rotated about the latch pin when the door is closed. This arrangement is very successful for normal opening and closing of the automobile doors. However, the relative positioning of the latch pin and the clasping mechanism is critical for the proper operation of such a system. Consequently, this arrangement becomes very unreliable when the vehicle is subjected to an impact that may force the door and the door jamb out of alignment. It is often quite common for doors to spring open when the vehicle is subject to impact because such impact often forcibly misaligns the door and the door jamb, or deforms the door causing the clasping mechanism to partially rotate and separate from the latch pin.

Also, conventional latch pins normally pick up grease or other lubricants used with the door clasping mechanism. Such lubricants can be transferred to the clothing or skin of occupants when entering or exiting the vehicle. Also, under some circumstances, the clasping mechanism, as well as the exposed latch pins, can become hazardous to the passengers. Further, the latch pins and the clasping mechanism, as well as the exterior handles used to operate them, are often considered unsightly and thus, not well suited for vehicles being displayed in shows.

Many of the aforementioned characteristics can lead to hazardous conditions. Some remain despite the many efforts made in the conventional art to correct these deficiencies.

Many of these drawbacks have been addressed in related patent application Ser. No. 08/908,254. However, in many security door arrangements, especially those in armored vehicles, extremely simple and durable mechanisms are a necessity. In particular, the use of electrical door switches, which can be deteriorated by hard or constant use, is not suitable for all applications requiring a security door latch mechanism. Also, in many security door applications, there is need for a secondary or auxiliary latching mechanism that is extremely reliable, and latches under all conditions, eventhough the primary latching system may not engage.

SUMMARY OF THE INVENTION

It is a first object of the present invention to provide a security door latching mechanism mounted in the interior of the door and the interior of a complementary door jamb in order to keep the latching mechanism hidden and secure.

It is an additional object of the present invention to provide a vehicle door latching mechanism that is impact resistant so as to hold the vehicle door in a closed position even when the vehicle is subjected to impact.

It is another object of the present invention to provide a hidden vehicle door latch mechanism that does not detract from the appearance of the vehicle when used for display purposes.

It is still another object of the present invention to provide a automobile door latching mechanism that can be directly and positively operated to latch and unlatch the vehicle door.

It is a further object of the present invention to provide a vehicle door latching mechanism that does not require extensive exposed lubricants.

It is yet an additional object of the present invention to provide a vehicle door latching mechanism that is amenable to electrical actuation for both latching and retracting the mechanism.

It is yet another object of the present invention to provide vehicle door latching mechanism for which the latch mechanism is completely retracted and inaccessible when the vehicle door is in an open position, thereby eliminating any chance of human contact with the latching mechanism.

It is still a further object of the present invention to provide a security door latching mechanism that can operate in a "fail-safe" locked mode whenever certain predetermined conditions exist.

It is yet another object of the present invention to provide a security door latching mechanism that resists binding of the locking shaft with the receiver.

It is still an additional object of the present invention to provide a simplified security door latching mechanism that does not depend upon door switches.

It is yet a further object of the present invention to provide a security door latching mechanism that operates in a fail safe manner.

It is still another object of the present invention to provide a security door auxiliary latching mechanism that operates even when the primary security door latching mechanism fails.

These and other objects of the present invention are achieved though the use of a security door latching mechanism that includes a latching mechanism arranged on the door and a complementary receiver arranged on the complementary door jamb. The latching mechanism includes a plunger shaft arranged to forcibly extend from the door into the receiver in the door jamb when in an extended position. A slide means for guiding the plunger shaft into the receiver is provided as part of the receiver. An actuating device is used to forcibly maintain the plunger shaft in an extended position when power is not provided to the actuating device. Constant power is necessary for the actuating device to retract and hold the plunger shaft away from the receiver.

A second aspect of the present invention achieves the desired objects and goals of the present invention through the use of a security door auxiliary latching mechanism for use on a door having a primary latching mechanism. The auxiliary latching mechanism includes a plunger shaft arranged to forcibly extend from the door into a complementary receiver on the door jamb in the extended position. The receiver includes guide means for sliding the shaft into the receiver. An actuating device is used to forcibly maintain the plunger shaft in an extended position when power is not provided to the actuating device. Thus, constant power is necessary for the actuating device to retract and hold the plunger shaft away from the receiver.

BRIEF DESCRIPTION OF THE DRAWINGS

FIG. 5(*b*) is a top view of the receiver used in a second embodiment of the present invention.

DESCRIPTION OF THE PREFERRED EMBODIMENTS

The novel features of the present invention may be best understood by reference to FIGS. 1, 2, 3 and 4 each of which includes the same elements that are labeled by the same designation numerals. When considered that the present invention is used with a conventional security door and door jamb, the distinctions between the present invention depicted in FIGS. 1 and 2 and security door latching mechanisms of the conventional art become apparent.

Figure 1:
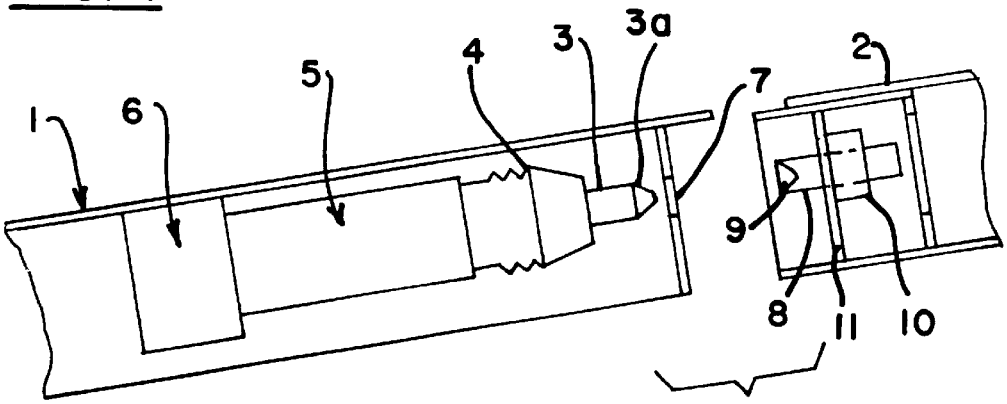
FIG. 1 is a top view of a diagram depicting the latch mechanism in the retracted position (door open).
Figure 2:
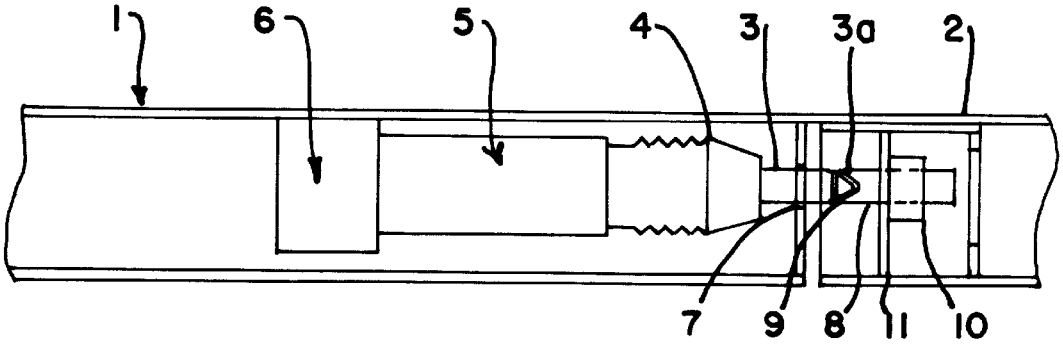
FIG. 2 is a top view of a cut away diagram depicting the latching mechanism in the extended position (door closed).

A preferred embodiment of the present invention is used in an environment constituted by vehicle door 1 and door frame or jamb 2. Both the door and the jamb are of standard vehicle design which need little modification to easily accommodate the mechanism of the present invention as depicted in FIGS. 1 and 2. Such adjustments are easily within the capabilities of those skilled in the art of automotive fabrication and/or adjustment. As is apparent from these drawings, the latching mechanism of the present invention operates along the longitudinal axis of the door 1 and perpendicular to the door jamb 2.

A key feature of the present invention resides in the actuating mechanism 5, which extends plunger shaft 3 to receiver 8 (in door jamb 2) and retracts the plunger shaft away from the receiver to allow the door 1 to open. Normally, the actuator forcibly maintains the plunger shaft in the extended position with a spring or other well-known technique. In normal operation, the plunger shaft 3 is retracted (though aperture 7 in the door closure) by providing electrical power from power supply 6 to actuator 5. Retraction is normally carried out through the use of an electromagnetic or another equivalent mechanism contained in the door actuator. In order for the plunger shaft to remain in the retracted position, power has to be maintained to the actuator. Thus, any power loss to the power supply 6 will cause the plunger shaft to immediately move into the extended position.

Figure 3:
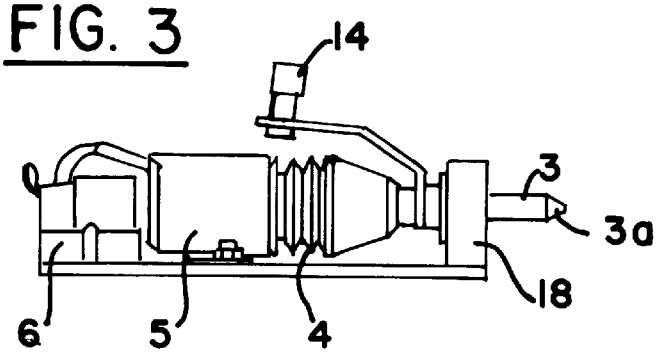
FIG. 3 is a side elevation view of the latching mechanism, depicting additional features of the present invention.
Figure 4:
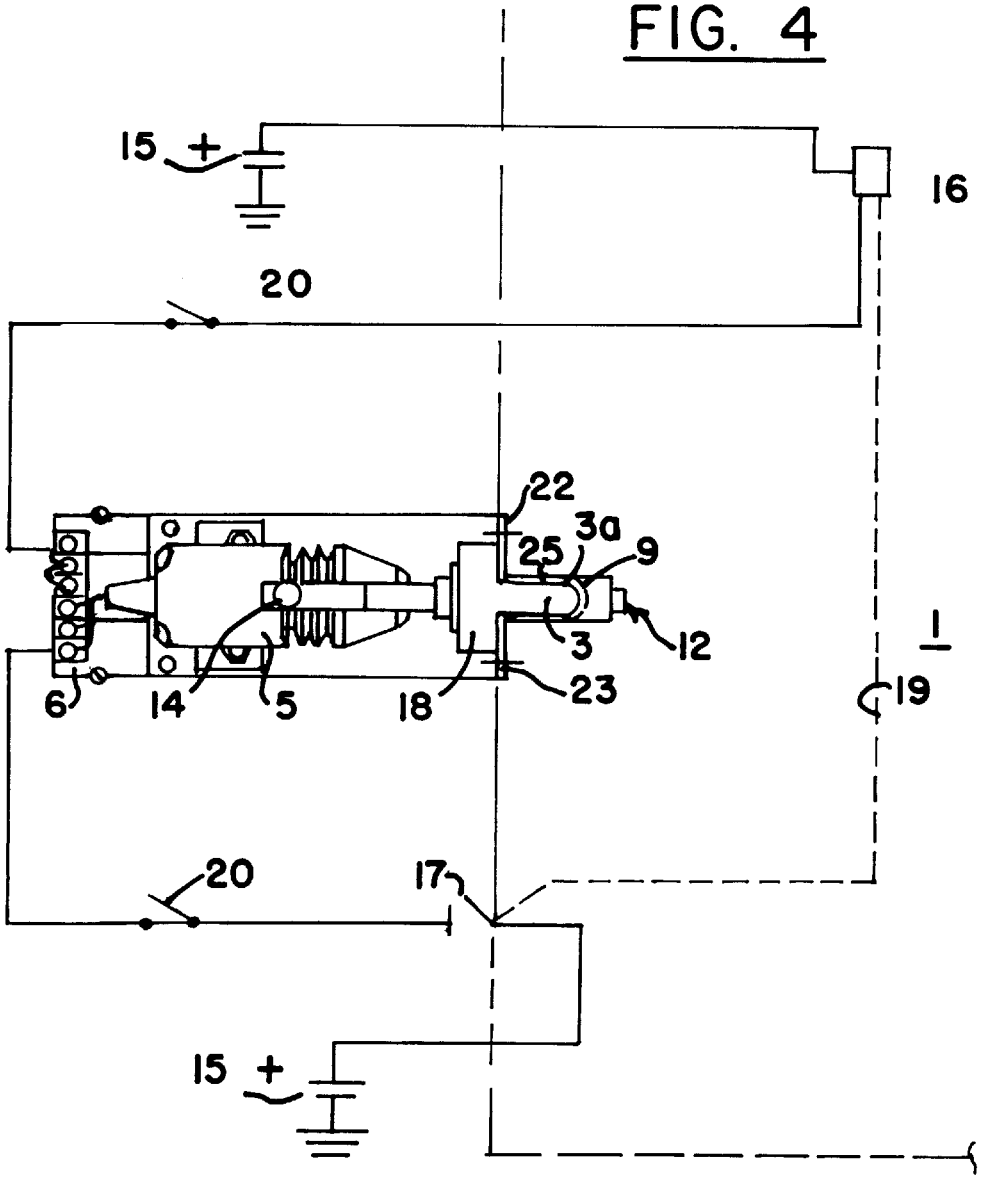
FIG. 4 is a top view of a different arrangement of the latching mechanisms and receiver, mounted in the door jamb and the door, respectively.

Another way of moving the plunger shaft 3 into the retracted position is through the use of a mechanical override lever 14 (as depicted in FIGS. 3 and 4). This is especially important when the present invention is mounted in a vehicle door which might be subject to an impact where electrical power is lost. Normally the mechanical override lever would be located inside the vehicle in order to maintain the smooth appearance of the vehicle side. However, multiple levers could be mounted so as to operable from either the interior of the vehicle or the exterior of the vehicle. Further, a lever operable from the exterior of the vehicle could be detachable and used only when necessary by placing one end of the lever into a slot (not shown) to access plunger shaft 3 to temporarily pull it into the retracted position.

Power supply 6 is necessary to provide the correct amount of power to operate the electromagnetic or any other device necessary to retract plunger shaft 3. The power supply can be controlled by a number of switches. For example, the latching switch 16 (in FIG. 4) is an electrical switch which normally latches into a closed position to maintain power to the power supply. The power source attached to the switch is preferably the car battery 15. However, other power sources can be used where appropriate.

Another method of controlling the operation of the actuator by provinding power to the power supply 6 is through the use of door switch 17. This element operates to cut off all electrical power to power supply 6 thereby releasing power shaft 3 into the extended position when the door to the vehicle closes. Thus, door switch 17 is normally opened when the door to the vehicle is closed and normally closed when the door to the vehicle is opened. Also, door switch 17 resets latching switch 16 so as to ensure that no power to the actuator 5 is provided by the power supply unless switch 16 is activated once more by an operator. This operation is ensured through the use of linkage 19 which can be either electrical or mechanical. The key component of the operation is that the opening of door switch 17 also opens latching switch 16.

Additional safeguards can be built into the system through the use of fail safe switches 20 which are operated based upon the drive mode of the vehicle. For example, fail safe switches 20 remain open whenever the vehicle is in the drive or reverse mode so as to prevent power from reaching power supply 6 to retract plunger shaft 3. As a result, the plunger shaft remains securely within the receiver 8 and the door remains secure. Other protective and safety measures will be apparent to any practitioners already familiar with this art, and can be used with the present invention as described with respect to the fail safe switches and the door switch.

Other measures are available to operate latching switch 16. As previously discussed, this switch can be controlled from either the exterior or the interior of the vehicle, or both. Further, the switch can be controlled by way of radio frequency signals, or by infra-red signals in a manner that is well known for locking and unlocking vehicle doors. Also, an electronic key pad can be used to operate latching switch 16, as well as a mechanical key and lock.

The latching mechanism includes a protective boot 4 made of rubber or a similar flexible material arranged around plunger shaft 3, protecting it in both of the extended (FIG. 2) and withdrawn or retracted (FIG. 1) positions. The protective boot need only be flexible enough to accommodate the two positions of plunger shaft 3 and it's connection with actuating cylinder 5. This interface is critical since the mechanism that moves plunger shaft 3 is contained in actuating cylinder 5. Consequently, without the protection of boot 4, the interface between actuating cylinder 5 and plunger shaft 3 will be vulnerable to dirt or other contaminants that could degrade the mechanism which moves plunger shaft 3. The mechanism itself is a well known arrangement to one skilled in this art and need not be elaborated upon further for purposes of the present invention.

Whatever kind of control mechanism is used, the key operation of the present invention includes plunger shaft 3 extending through an aperture 7 in the door structure perpendicular to the longitudinal axis of the door and into recess 9 (preferably a conical concavity) in receiver 8 located in door jamb 2. The plunger shaft has a conical portion 3(*a*) which is tightly received in recess 9 to ensure a secure bond between door 1 and jamb 2.

Although a first embodiment has been described as arranging latching mechanism within a vehicle door and the receiver within the vehicle door jamb, it is noted that the electrical wiring necessary for the present invention may be more easily installed if the touching mechanism is arranged within the door jamb while the receiver is arranged within the door itself. FIG. 4 depicts this particular arrangement which is virtually the same as that of FIGS. 1 and 2. It is noted that for increased security, the mounting of the latching mechanism can be strengthened by mounting plate 18 (in FIG. 3) which is used to anchor the actuator firmly between the two major parallel walls of the door or the door jamb. This also aids in effecting a relatively precise mounting between the latching mechanism and the receiver. This precision is highly desirable because a tight fit between the receiver 8 and the plunger shaft 3 provides for a more solid closure of the door within the door jamb.

This is further effected by the use of a conically-shaped distal end 3(*a*) of plunger shaft 3. The conical portion is arranged to fit precisely within recess 9 which is shaped precisely as a conical concavity to accommodate the distal end. This interface is used to effect the tight fit between the latching mechanism and the receiver. On the other hand, the cylindrical space 25 which leads to recess 9 is fabricated with substantial tolerances to loosely accommodate plunger shaft 3 in order to avoid binding or jamming the plunger shaft in the receiver. For example, in a preferred embodiment the receiver is 9/16 inch in diameter while the plunger shaft is ½ inch in diameter. This provides a tolerance between these two elements of 12½% to prevent binding between the plunger shaft and the recess. This can be especially critical if the vehicle undergoes an impact that deforms the door and/or the door jamb.

In order to ensure precision of fit between distal end 3(*a*) and recess 9, it is necessary that the receiver be adjustable within either the door 1 or the door jamb 2. Adjustments perpendicular to the plunger shaft 3 are carried out by adjusting mounting plate 22 using bolts 23. Preferably, the receiver 8 is formed as a solid piece with mounting plate 22 so that adjustment either vertically or horizontally (perpendicular to the longitudinal axis of plunger shaft 3) will allow precise alignment along a single longitudinal line for both plunger shaft 3 and receiver 8. Distance between recess 9 and distal end 3(*a*) is adjusted by adjusting screw 12 which moves the recess 9 along the axis of plunger shaft 3.

FIGS. 3 and 4 depict typical dimensions for an embodiment of the present invention to be mounted in a vehicle door. However, larger versions of the present invention can be used for larger vehicles just as smaller versions of the present invention can be used for smaller vehicles. Further, the present invention is not limited to vehicles. Rather, the latching mechanism of the present invention can be placed within the door of any structure having sufficient thickness to accommodate such a mechanism. It is presumed that such structures will be steel security doors. However, hollow wooden doors, or wooden doors with hollowed out portions can accommodate the mechanism of the present invention. The same type of door switch (17 in FIG. 4) can be used to deactivate the electrical system and forcibly send plunger shaft 3 into the extended position as soon as a door to a building closes just as described for the door to a vehicle. All the accommodations described with respect to vehicle doors can be applied to security doors for fixed structures when using the present invention.

Figure 5A:
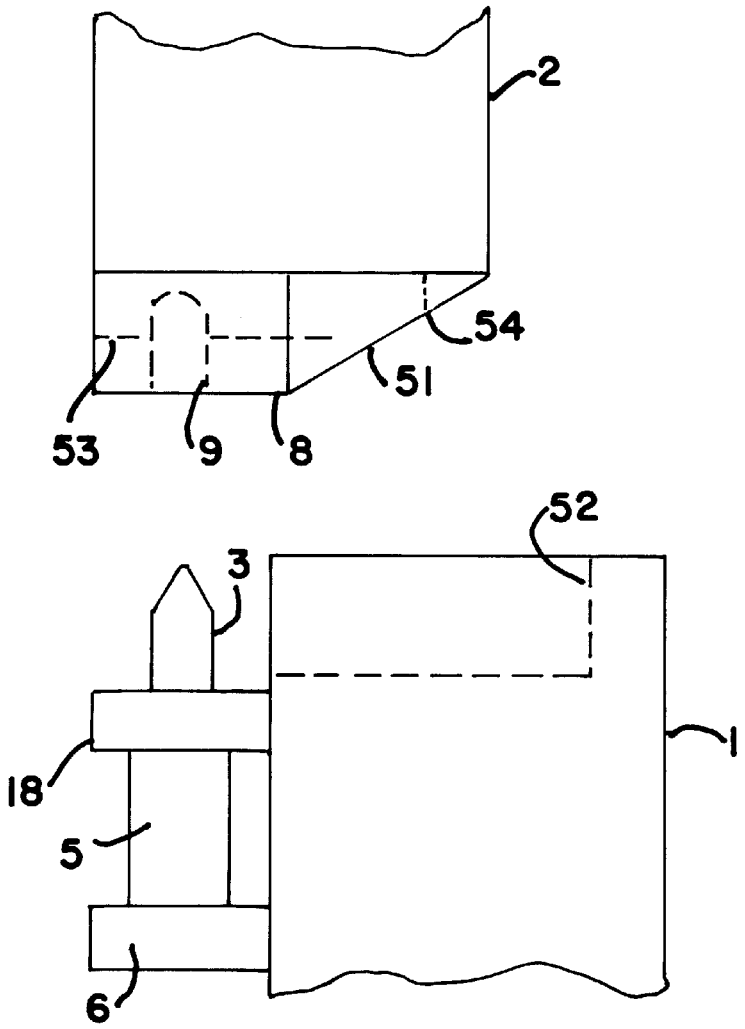
FIG. 5(*a*) is a side elevation view of the auxiliary latching mechanism constituting the second embodiment of the present invention.
Figure 5B:
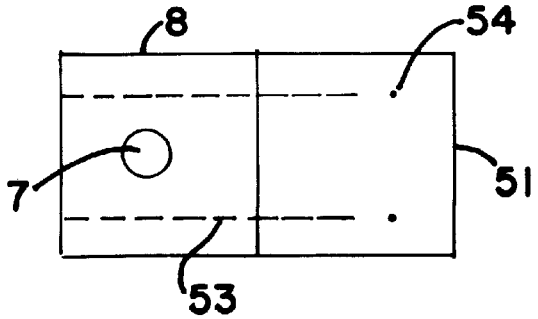

A second embodiment of the present invention is depicted in FIGS. 5(*a*) and 5(*b*). The drawing designation numerals are the same in these drawings as they are in the other four drawings. Further, the actuation device operates in exactly the same manner as that described for the previous embodiment. In fact, the second embodiment operates in the same manner as the first. The only difference is in the arrangement of the mounting, providing for a far more robust system than that found in the first embodiment.

Unlike the arrangement of the first embodiment, the latching mechanism and receiver 8 of FIG. 5 are not mounted within the interior of either the door 1 or the door jamb 2, respectively. Rather, the portion of the device that includes the plunger shaft 3, actuator 5 and power supply 6 is mounted on the interior side of the security door. Also, the receiver is mounted on the bottom of the door jamb, rather than within it. Both portions of the latching mechanism are held to the respective door and door jambs with mounting screws (generally not shown).

Also, the receiver 8 includes an additional piece not found in the first embodiment. The additional piece is in the form of a wedge-shaped guide 51. The guide is mounted next to the receiver and positioned so that the tip of the thin portion of the wedge is approximately even with the edge of the door jamb 2. The portion of the mechanism including the plunger shaft 3 and actuator 5 is positioned on the surface of the vehicle door 1 so that the plunger shaft when in it's fully extended position will fit under the tip of the thin portion of the wedge when the door is moved to the door jamb.

As the door 1 is moved into the door jamb 2, the guide 51 forces the plunger shaft 3 further into a retracted position so that the plunger shaft is fully retracted when it reaches the top of the wedge. The movement of the door with respect to the door jamb carries the plunger shaft (now in the fully retracted position past the top of the wedge along the upper surface of the receiver to the recess 9. At this point, the plunger shaft is driven out into the recess as the door reaches the closed position with respect to the door jamb.

In the second embodiment the tolerance between the plunger shaft and the diameter of the recess 9 is approximately 1/16 to ⅛ inch, from approximately 12½% to 25%. This means that the fit between the plunger shafts and the receiver will always be loose, so that a certain degree of movement between the door and the door jamb will permitted. This is acceptable and even desirable when the latching mechanism is being used as an auxiliary latching mechanism or fail safe purposes. In such an arrangement, should the primary latching mechanism (not shown) fail to engage, the fail-safe latching mechanism of the second embodiment will still engage by virtue of the simple movement of the door with respect to the door jamb. The noise created by the motion between the door and the door jamb will also alert the occupants of the vehicle to the fact that the main door latch has not engaged while still loosely holding the door within the door jamb. However, lower tolerances between the plunger shaft and the receiver could be maintained so that the latching mechanism in the second embodiment could serve as the primary latching mechanism, holding the door and the jamb tight with respect to each other.

The wedge-shaped guide 51 and the receiver 8 are generally formed as two separate pieces which are connected to each other by way of horizontal screws 53. The wedge-shaped guide is also connected to the door jamb by means of vertical screws. The recess or hole 9 in the receiver is generally offset with respect to the vertical sides of the block so that the receiver block can be mounted in at least two different positions to accommodate various fits between the door and the door jamb. Likewise, because the portion of the latching mechanism containing the plunger shaft 3 and the actuator 5 is mounted on the surface of the door 1 (rather than the interior), substantial variation in the position of this portion is permitted with respect to both the door and the door jamb. This facilitates precise positioning to allow as accurate a fit as possible.

In order to accommodate the wedge-shaped guide 51 as well as the receiver 8 mounted on the bottom of the door jamb 2 (rather than the interior), a cutout 52 is arranged on the door 1. The height of the cutout is sized so as to accommodate the thickness of the receiver block while the width of the cutout is sized to accommodate the width of the combined guide and receiver block. The depth of the cut out is sized to accommodate the length of the wedge-shaped guide which must extend into the door itself in order for the plunger shaft to mate with the receiver 8.

Although preferred embodiments have been described by way of example, the present invention should not be construed as being limited thereby. Consequently, the present invention should be considered to include any and all equivalents, modifications, variations and other embodiments limited only by the scope of the appended claims.

I claim:

1. A latching mechanism and complementary receiver adapted to be contained within interiors of a door and a complementary door jamb, said latching mechanism comprising:

(a) an elongated plunger shaft having a cylindrical body and a substantially conical distal end arranged to extend from said door into said complementary receiver in said door jamb when said plunger shaft is in an extended position, said receiver having a cylindrical concavity terminating in a substantially conical concavity, said plunger shaft and said cylindrical and substantially conical concavities being respectively configured so that said substantially conical distal end of said plunger haft fits tightly into said substantially conical concavity while said cylindrical body of said plunger shaft fits loosely in said cylindrical concavity so that a diameter of said cylindrical body of said plunger shaft and a diameter of said cylindrical concavity have a predetermined size difference;

(b) a power supply arranged to provide electrical power to said latching mechanism; and, (c) actuating means for forcibly maintaining said plunger shaft in an extended position, and for retracting said plunger shaft away from said receiver only when said actuating means is provided with electrical power, (d) guide means for sliding said plunger shaft into said complementary receiver.

2. The apparatus of claim 1, wherein said door is that of an automotive vehicle.

3. The apparatus of claim 2, further comprising:

(e) a boot arranged to cover an intersection where said plunger shaft enters said actuating means.

4. The apparatus of claim 3, wherein said actuating means comprise an electromagnet and at least one spring.

5. The apparatus of claim 3, further comprising:

(f) a latching switch arranged for providing electrical power to retract said plunger shaft, said latching switch arranged to remain in a closed position until reset.

6. The apparatus of claim 5, further comprising:

(g) a manual lever arranged to pull said plunger shaft to a retracted position away from said receiver, said manual lever extending through said door.

7. The apparatus of claim 6, further comprising:

(h) a door switch arranged to cut off power to said power supply and to latch said latch switch in an open position when said door is closed.

8. The apparatus of claim 7, further comprising:

(i) at least one operational cut off switch to prohibit all power to said power supply when said vehicle is in the drive or reverse modes of operation.

9. The apparatus of claim 1, wherein said plunger shaft has an approximately cone-shaped distal end that enters said receiver.

10. The apparatus of claim 9, wherein said diameter of said plunger shaft and said diameter of said cylindrical concavity are configured to have a tolerance between them of substantially 12½% to 25%.

11. The apparatus of claim 10, wherein said receiver comprises first adjusting means for moving said receiver along a longitudinal axis of said plunger shaft.

12. The apparatus of claim 11, wherein said receiver further comprises a second adjusting means for moving said receiver in directions perpendicular to said longitudinal axis of said plunger shaft.

13. The apparatus of claim 5, wherein said latching switch is responsive to radio frequency signals.

14. The apparatus of claim 5, wherein said latching switch is responsive to infrared-signals.

15. The apparatus of claim 5, wherein said latching switch is operable by a mechanical key.

16. The apparatus of claim 5, wherein said latching switch is operable by an electronic key pad.

17. The apparatus of claim 1, wherein said guide means is formed in the shape of a wedge.

18. The apparatus of claim 17, wherein a cut out is arranged in said door to accommodate said guide means and said receiver.

19. An auxiliary latching mechanism and complementary receiver adapted to be mounted on a door and complementary jamb having a primary latching mechanism said auxiliary latching mechanism and complementary receiver arranged to be mounted on said door and complementary jamb, and comprising:

(a) an elongated plunger shaft having a cylindrical body and a substantially conical distal end arranged to extend from said door into said complementary receiver in said door jamb when said plunger shaft is in an extended position, said complementary receiver having a cylindrical concavity terminating in a substantially conical concavity, said plunger shaft and said cylindrical and substantially conical concavities being respectively configured so that said substantially conical distal end of said plunger shaft fits tightly into said substantially conical concavity while said cylindrical body of said plunger shaft fits loosely in said cylindrical concavity so that a diameter of said cylindrical body of said plunger shaft and a diameter of said cylindrical concavity have a predetermined size difference;

(b) a power supply arranged to provide electrical power to said latching mechanism; and, (c) actuating means for forcibly maintaining said plunger shaft in an extended position, and for retracting said plunger shaft away from said receiver only when said actuating means is provided with electrical power.

(d) guide means for sliding said plunger shaft into said complementary receiver.

* * * * *